US007444709B1

(12) United States Patent
Chu

(10) Patent No.: US 7,444,709 B1
(45) **Date of Patent: *Nov. 4, 2008**

(54) DUAL HEAD INTERDENTAL TOOTHBRUSH

(76) Inventor: Henry C. Chu, 133N. Lemon St., Orange, CA (US) 92866

( * ) Notice: Subject to any disclaimer, the term of this patent is extended or adjusted under 35 U.S.C. 154(b) by 0 days.

This patent is subject to a terminal disclaimer.

(21) Appl. No.: 11/811,733

(22) Filed: Jun. 12, 2007

(51) Int. Cl.
*A46B 9/04* (2006.01)

(52) U.S. Cl. ..... 15/167.1

(58) Field of Classification Search ..... 15/167.1
See application file for complete search history.

(56) References Cited

U.S. PATENT DOCUMENTS 4,395,943 A 8/1983 Brandli
4,691,404 A 9/1987 Tarrson et al.
5,309,596 A 5/1994 Simms
5,488,751 A 2/1996 Gekhter et al.
5,699,578 A * 12/1997 Dumler et al. ..... 15/167.1
5,862,559 A * 1/1999 Hunter ..... 15/28

* cited by examiner

*Primary Examiner*—Randall Chin
(74) *Attorney, Agent, or Firm*—Charles E. Baxley

(57) ABSTRACT

An interdental toothbrush device includes a handle having one or more wires and fixed filaments disposed on each end, and a gage disposed on an outer end portion of the wires and having an outer diameter equal to or smaller than that of the filaments for limiting and guiding the wires and the filaments to engage into the predetermined or suitable or selected interdental spaces between the teeth of the user and for preventing the filaments from being inserted and engaged into the interdental spaces having a relatively smaller width and thus for preventing the user's gum from being hurt or injured by the greater filaments.

7 Claims, 3 Drawing Sheets

DUAL HEAD INTERDENTAL TOOTHBRUSH

BACKGROUND OF THE INVENTION

1. Field of the Invention

The present invention relates to an interdental toothbrush assembly, and more particularly to a dual head interdental toothbrush assembly including one or more interdental toothbrush devices each having filaments provided on each of two ends of a handle and a gage provided on each end of the handle for guiding the filaments to be inserted or engaged into the predetermined or suitable interdental spaces between the teeth and for preventing the filaments of greater sizes or diameters from being inserted or engaged into the interdental spaces having relatively smaller sizes or widths.

2. Description of the Prior Art

Typical interdental toothbrushes comprise one or more twisted wires having fixed filaments between turns of the wire or wires for inserting or engaging into the interdental spaces between the teeth and particularly designed for cleaning the hard-to-reach interdental spaces between the teeth of the users.

For example, U.S. Pat. No. 4,395,943 to Brandli discloses one of the typical interproximal toothbrushes also comprise one or more twisted wires having fixed filaments between turns of the wire or wires for inserting or engaging into the interdental spaces between the teeth, and an electrically insulated, wear-resistant and elastic layer applied onto the outer portion of the wire or wires.

Normally, in one package of the typical interproximal toothbrushes, two or more brushes or refills having different shapes or sizes or diameters may be provided, and the brushes or refills may be selected from such as the ultra fine cylindrical shapes, the ultra fine tapered shapes, the cylindrical shapes, the tapered shapes, the large cylindrical shapes, or the like.

However, when the interdental toothbrushes of greater sizes or diameters are forced to be inserted or engaged into the interdental spaces having relatively smaller sizes or widths, the gum of the user may be hurt or injured by the interdental toothbrushes. In addition, the twisted wires may also have a good chance to hurt or injure the gum of the user when the twisted wires of the interdental toothbrushes are not precisely engaged into the interdental spaces between the teeth.

U.S. Pat. No. 4,691,404 to Tarrson et al., U.S. Pat. No. 5,309,596 to Simms, and U.S. Pat. No. 5,488,751 to Gekhter et al. discloses three further typical interproximal toothbrushes each comprise a handle, and one or more twisted wires secured to the handle and having fixed filaments between turns of the wire or wires for allowing the interproximal toothbrushes to be suitably inserted or engaged into the interdental spaces between the teeth with the handles.

However, similarly, the interdental toothbrushes of greater sizes or diameters may be inadvertently forced or inserted or engaged into the interdental spaces having relatively smaller sizes or widths, and the gum of the user may also have a good chance to be hurt or injured by the interdental toothbrushes. In addition, the twisted wires may also have a good chance to hurt or injure the gum of the user when the twisted wires of the toothbrushes are not precisely engaged into the interdental spaces between the teeth.

Furthermore, normally, the typical interproximal toothbrushes comprise only one brush or refill at one end for inserting or engaging into one of the interdental spaces between the teeth such that a large number of typical interproximal toothbrushes are required to be provided and prepared and disposed in one interproximal toothbrush package.

The present invention has arisen to mitigate and/or obviate the afore-described disadvantages of the conventional interdental toothbrushes.

SUMMARY OF THE INVENTION

The primary objective of the present invention is to provide an interdental toothbrush assembly including one or more interdental toothbrush devices each having filaments provided on each of two ends of a handle and a gage provided on each end of the handle for guiding the filaments to be inserted or engaged into the predetermined or suitable interdental spaces between the teeth and for preventing the filaments of greater sizes or diameters from being inserted or engaged into the interdental spaces having relatively smaller sizes or widths.

In accordance with one aspect of the invention, there is provided an interdental toothbrush device comprising a handle including two ends, at least one wire attached to each of the ends of the handle, including an outer end portion, and filaments disposed on each of the wires of the ends of the handle, and a gage disposed on the outer end portion of each of the wires and including an outer diameter corresponding to that of the filaments for limiting the filaments to engage into a predetermined interdental space between teeth of a user and for preventing the filaments from being inserted and engaged into an interdental space having a relatively smaller width and for preventing the user's gum from being hurt or injured by the filaments.

The gage includes an outer diameter equal to or slightly smaller than that of the filaments, and is preferably made of soft or rubber or plastic or synthetic or resilient materials for engaging with the user's gum and for preventing the user's gum from being hurt and injured by the wire.

The wire includes a wire segment provided thereon and located between the gage and the filaments. The gage includes a rounded structure or a spherical structure for further preventing the user's gum from being hurt and injured by the wire.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
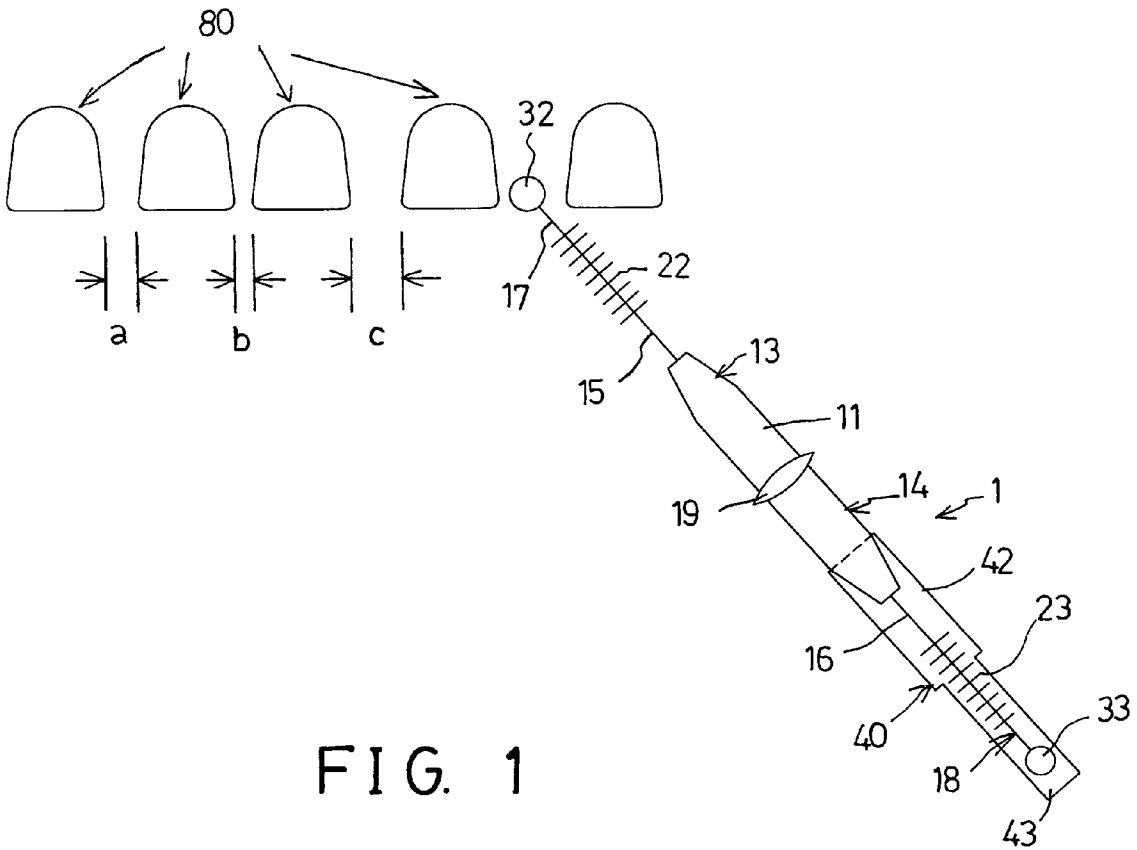
FIG. 1 is a partial perspective view illustrating the operation of an interdental toothbrush device of an interdental toothbrush assembly in accordance with the present invention for being inserted or engaged into the interdental spaces between the teeth of the user.
Figure 2:
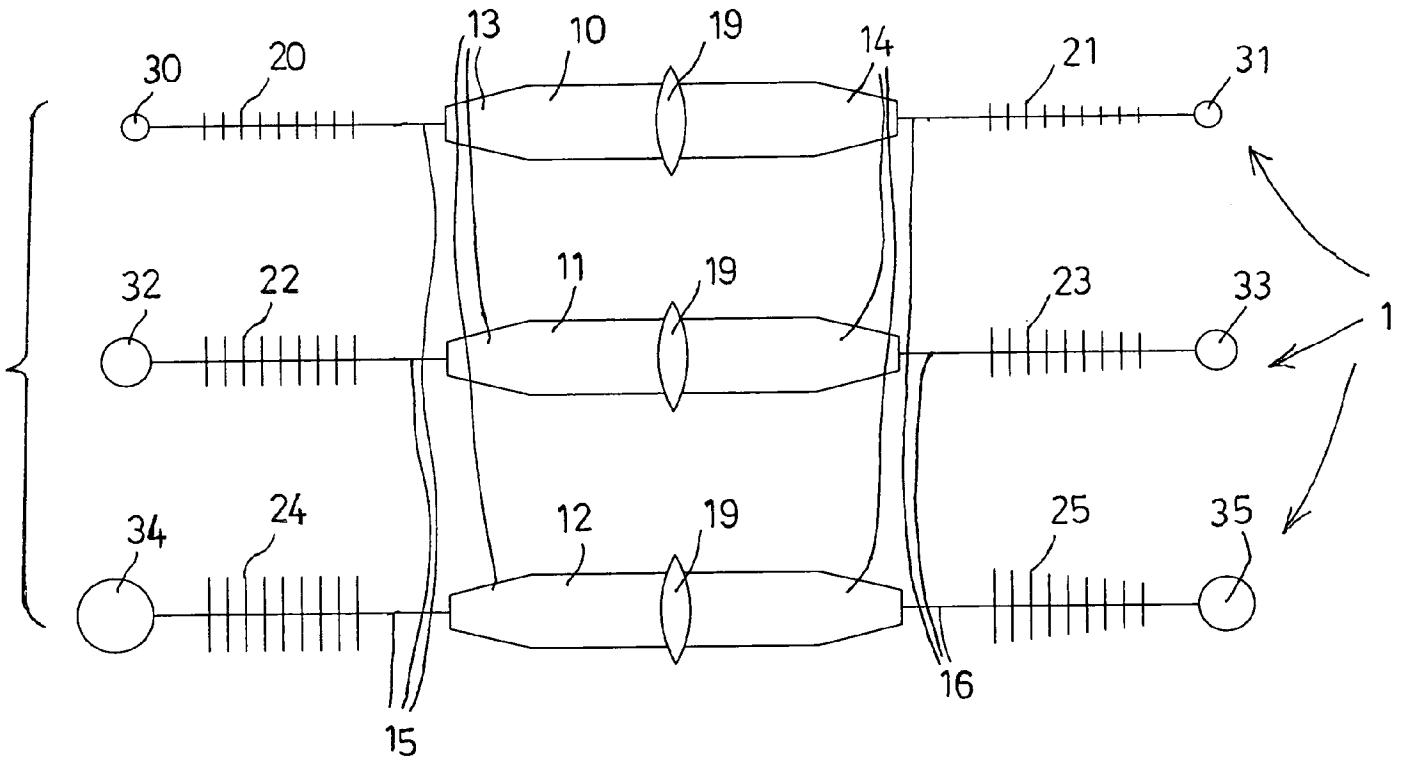
FIG. 2 is a partial plan schematic view illustrating one set of the interdental toothbrush devices of the interdental toothbrush assembly.

Referring to the drawings, and initially to FIGS. 1 and 2, an interdental toothbrush assembly in accordance with the present invention comprises one or more interdental toothbrush devices 1 (FIG. 2) each including a handle 10, 11, 12 having two ends 13, 14, and twisted wires 15, 16 attached to or extended from the two ends 13, 14 of the handle 10-12 respectively, and fixed filaments 20, 21, 22, 23, 24, 25 disposed or attached between turns of the wire or wires 15, 16 at each of the two ends 13, 14 of the handle 10-12 for inserting or engaging into the selected or suitable interdental spaces a or b or c (FIG. 1) between the teeth 80 of the user and particularly designed for cleaning the hard-to-reach interdental spaces a or b or c between the teeth of the users. Normally, two wires are attached to or extended from each of the ends 13, 14 of the handle 10-12 and twisted for fixing and securing the filaments 20-25 to the handle 10-12.

The filaments 20-25 may be formed into or selected from various kinds of different shapes or contours or sizes or diameters, such as the ultra fine cylindrical shaped filaments 20, the ultra fine tapered shaped filaments 21, the cylindrical shaped filaments 22, the tapered shaped filaments 23, the large cylindrical shaped filaments 24, the large tapered shaped filaments 25 or the like. For example, the ultra fine cylindrical shaped filaments 20 may include a size or diameter smaller than that of the cylindrical shaped filaments 22 which may include a size or diameter smaller than that of the large cylindrical shaped filaments 24. Similarly, the ultra fine tapered shaped filaments 21 may include a size or diameter smaller than that of the tapered shaped filaments 23 which may include a size or diameter smaller than that of the large tapered shaped filaments 25.

Normally, in one refill package of the interproximal toothbrush assemblies, the filaments 20-25 of the brushes or refills or toothbrush devices 1 of that shown in FIG. 2 may include different shapes or sizes or diameters and may be selectively provided and contained in the package for allowing the users to select the filaments 20-25 of the required shapes or sizes or diameters. The handles 10-12 may be used for suitably inserting or engaging the wire or wires 15, 16 and the filaments 20-25 into either of the interdental spaces a or b or c between the teeth 80 of the user and for moving or actuating the filaments 20-25 to clean the interdental spaces between the teeth of the users.

The interdental toothbrush assembly in accordance with the present invention further includes a wire segment 17 selectively, but not necessarily formed or extended or provided on the outer end portion 18 of each of the wires 15, 16 and having no filaments formed or provided thereon, and a gage 30, 31, 32, 33, 34, 35 disposed or attached to the outer end portion 18 of each of the wires 15, 16 or of the wire segment 17 of each of the wires 15, 16 and arranged for allowing the wire segment 17 to be formed and provided or located between the gages 30-35 and the filaments 20-25 respectively. The gages 30-35 are preferably made of soft or rubber or plastic or resilient or other synthetic materials and includes a rounded or spatial or three dimensional or spherical structure for safely engaging with the user's gum and for safely inserting or guiding the wire or wires 15, 16 and the filaments 20-25 to engage into the interdental spaces a or b or c between the teeth 80 and thus for preventing the gum of the user from being hurt or injured by the wire or wires 15, 16.

The gages 30-35 each include a size or outer diameter equal to or slightly smaller than or corresponding to that of the respective filaments 20-25 for limiting or guiding the filaments 20-25 of the interdental toothbrush devices 1 to be inserted or engaged into the predetermined or suitable interdental spaces a or b or c between the teeth 80 and for preventing the filaments 20-25 of greater sizes or diameters from being inserted or engaged into the interdental spaces a or b or c having relatively smaller sizes or widths. For example, the gages 30-31 may be inserted or engaged into all of the interdental spaces a, b, c, but the other greater filaments 22-25 may be prevented from being inserted or engaged into the relatively smaller interdental space b by the gages 32-35.

Similarly, the filaments 22-23 may be limited and guided to be inserted or engaged into the relatively greater interdental spaces a, c, except the relatively smaller interdental space b by the gages 32-33, and the greatest gages 34-35 may limit and guide the filaments 24-25 to engage into the greatest interdental spaces c only but not the relatively smaller interdental spaces a and b, or the greatest gages 34-35 may limit and prevent the filaments 24-25 from being inserted or engaged into the relatively smaller interdental spaces a and b.

The filaments 20-25 may thus be limited and guided to be inserted or engaged into only the predetermined or suitable or relatively greater interdental spaces between the teeth, and may prevent the filaments 20-25 of greater sizes or diameters from being inserted or engaged into the interdental spaces having relatively smaller sizes or widths, and thus may prevent the gum of the user from being hurt or injured by the filaments 20-25 having relatively greater sizes or diameters. In addition, the rounded or spatial or three dimensional or spherical gages 30-35 may also prevent the gum of the user from being hurt or injured by the wire or wires 15, 16.

Figure 3:
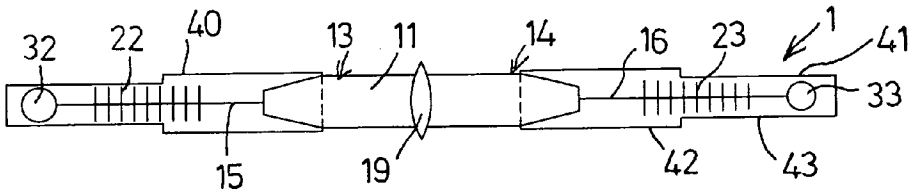
FIG. 3 is a plan schematic view illustrating one of the interdental toothbrush devices.
Figure 4:
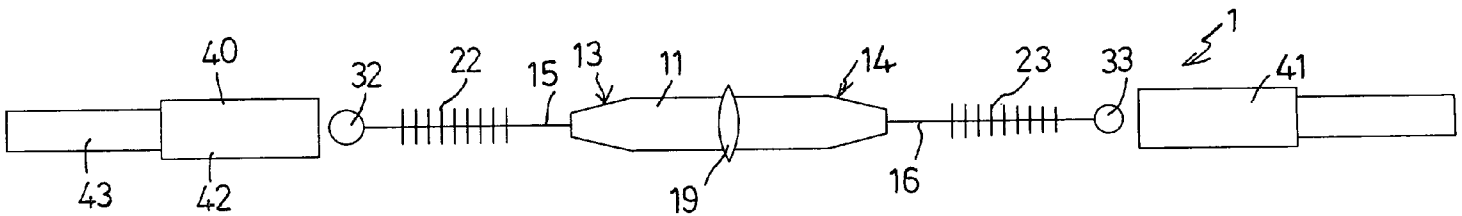
FIG. 4 is a plan and exploded view illustrating one of the interdental toothbrush devices.
Figure 5:
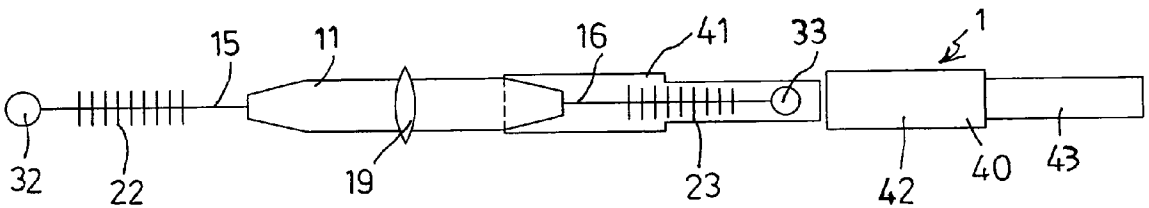
FIG. 5 is a plan and exploded view similar to FIG. 4, illustrating the operation of the interdental toothbrush devices.

As shown in FIGS. 3-5, the interdental toothbrush devices 1 each may include a rim or spacer 19 disposed on the middle portion of each of the handle 10-12 for separating the handle 10-12 into the two ends 13, 14, and two end caps 40, 41 for attaching onto the ends 13, 14 of the handle 10-12 for covering or shielding the wire or wires 15, 16 and the filaments 20-25 and the gages 30-35. The end caps 40, 41 each include a greater portion 42 having a relatively greater diameter for engaging onto the ends 13, 14 of the handle 10-12, and a smaller portion 43 having a relatively smaller diameter than that of the ends 13, 14 of the handle 10-12 for engaging onto the wire or wires 15, 16 and the filaments 20-25 and the gages 30-35.

As shown in FIG. 5, one of the end caps 40 may be disengaged or removed from the end 13 of the handle 10-12 for exposing the wire or wires 15, 16 and the filaments 20-25 and the gages 30-35, and the greater portion 42 of the end cap 40 may be selectively engaged onto the smaller portion 43 of the other end cap 41 for allowing the handle 10 and the end caps 40, 41 to be suitably grasped or held by the users and for suitably inserting or engaging the wire or wires 15, 16 and the filaments 20-25 into either of the interdental spaces a or b or c between the teeth 80 of the user. It is to be noted that the toothbrush devices 1 each include two ends 13, 14 having filaments 20-25 of different shapes or sizes or diameters for allowing the users to easily select the filaments 20-25 of the required shapes or sizes or diameters and for allowing the users to carry fewer interdental toothbrush devices 1.

Accordingly, the interdental toothbrush assembly includes one or more interdental toothbrush devices each having filaments provided on each of two ends of a handle and a gage provided on each end of the handle for guiding the filaments to be inserted or engaged into the predetermined or suitable interdental spaces between the teeth and for preventing the filaments of greater sizes or diameters from being inserted or engaged into the interdental spaces having relatively smaller sizes or widths.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An interdental toothbrush device comprising:

a handle including two ends, at least one wire attached to each of said ends of said handle, including an outer end portion, filaments disposed on each of said at least one wire of said ends of said handle, and a gage disposed on said outer end portion of each of said at least one wire and including an outer diameter substantially equal to that of said filaments for limiting said filaments to engage into a predetermined interdental space between teeth of a user and for preventing said filaments from being inserted and engaged into an interdental space having a relatively smaller width and for preventing the user's gum from being hurt or injured by said filaments.

2. The interdental toothbrush as claimed in claim 1, wherein said at least one wire includes a wire segment provided thereon and located between said gage and said filaments.

3. The interdental toothbrush as claimed in claim 1, wherein said gage includes an outer diameter equal to that of said filaments.

4. The interdental toothbrush as claimed in claim 1, wherein said gage includes an outer diameter smaller than that of said filaments.

5. The interdental toothbrush as claimed in claim 1, wherein said gage is made of soft materials for preventing the user's gum from being hurt and injured by said at least one wire.

6. The interdental toothbrush as claimed in claim 1, wherein said gage includes a rounded structure.

7. The interdental toothbrush as claimed in claim 1, wherein said gage includes a spherical structure.

* * * * *